US006969326B2

(12) United States Patent
De Shiell et al.

(10) Patent No.: US 6,969,326 B2
(45) Date of Patent: Nov. 29, 2005

(54) GOLF CLUB HEAD

(75) Inventors: Drew T. De Shiell, San Diego, CA (US); Kraig Willett, Fallbrook, CA (US); Michael Scott Burnett, Carlsbad, CA (US); Benoit Vincent, Leucadia, CA (US); Joseph Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 93 days.

(21) Appl. No.: 10/634,023

(22) Filed: Aug. 4, 2003

(65) Prior Publication Data

US 2004/0116208 A1 Jun. 17, 2004

Related U.S. Application Data

(63) Continuation-in-part of application No. 10/316,453, filed on Dec. 11, 2002, now abandoned.

(51) Int. Cl.[7] ..... A63B 53/04
(52) U.S. Cl. ..... 473/345; 473/349; 273/DIG. 7
(58) Field of Search ..... 473/324–350, 473/290–271; 273/DIG. 7

(56) References Cited

U.S. PATENT DOCUMENTS

| | | | | |
|---|---|---|---|---|
| 5,328,176 A | | 7/1994 | Lo | |
| 5,410,798 A | | 5/1995 | Lo | |
| 5,425,538 A | | 6/1995 | Vincent et al. | |
| 5,624,331 A | | 4/1997 | Lo et al. | |
| 5,776,011 A | * | 7/1998 | Su et al. | 473/345 |
| 6,299,547 B1 | | 10/2001 | Kosmatka | |
| 6,334,817 B1 | | 1/2002 | Ezawa et al. | |
| 2001/0049310 A1 | | 12/2001 | Cheng et al. | |
| 2002/0022535 A1 | | 2/2002 | Takeda | |
| 2002/0142859 A1 | | 10/2002 | Galloway et al. | |
| 2003/0032500 A1 | | 2/2003 | Nakahara et al. | |
| 2003/0083151 A1 | | 5/2003 | Nakahara et al. | 473/345 |
| 2003/0125127 A1 | | 7/2003 | Nakahara et al. | 473/329 |
| 2003/0134693 A1 | | 7/2003 | Nakahara et al. | 473/345 |

FOREIGN PATENT DOCUMENTS

| | | |
|---|---|---|
| JP | 05-317465 | 3/1993 |
| JP | 2002-165902 | 11/2002 |

* cited by examiner

*Primary Examiner*—Sebastiano Passaniti
(74) *Attorney, Agent, or Firm*—Sheppard, Mullin, Richter & Hampton LLP

(57) ABSTRACT

The present invention resides in a wood-type golf club head having a body, a striking face and a crown. The body defines a front opening and an upper opening, and it includes a sole and a side section that extends rearward of the front opening. The striking plate is secured to the body, enclosing the front opening. While partially assembled, final weighting and/or other attachment of other members to the inner surface of the club head can be preformed, as desired. The crown is secured to the body portion, enclosing the upper opening. A surface veil is disposed atop a junction of the crown and body. The crown has a maximum thickness no greater than about 2 mm. In a preferred embodiment, at least one of the striking plate and the crown is attached to the second portion by adhesive bonding.

28 Claims, 8 Drawing Sheets

GOLF CLUB HEAD

CROSS REFERENCE TO RELATED APPLICATION

This application is a continuation-in-part of application Ser. No. 10/316,453, filed Dec. 11, 2002, now abandoned which is herein incorporated by reference for all purposes.

BACKGROUND OF THE INVENTION

The invention relates generally to a wood-type golf club head and, more particularly, to a golf club head having a lightweight crown.

A wood-type golf club head includes a load-bearing outer shell with an integral or attached strike plate. Today's club head is typically formed of metal material and has a hollow cavity. The metal body may comprise several portions welded together or may include a cast body with a separate sole plate or strike plate that is welded in the appropriate location.

Most club heads today are made of a strong, yet lightweight metal material such as, for example, a titanium, steel or aluminum alloy. There have also been heads formed of carbon fiber composite material. The use of these materials is advantageous for the larger club heads now sought by golfers, i.e., at least 300 cc and up to about 500 cc in volume. The larger sized, yet conventionally weighted, club heads strive to provide larger "sweet spots" on the striking face and club moments of inertia that, for some golfers, make it easier to get a golf ball up in the air and with greater accuracy.

Various attempts have been made to attain an improved coefficient-of-restitution ("COR") for golf club heads, with much attention paid to the design of face plates having variable thickness. However, the durability of very thin portions of the face plate continues to be a problem. Such face plate designs are limited by the high impact loads to which these club heads are subject, in particular at the junctions of the face plate with the crown and sole of the club head.

Titanium alloys are particularly favored in club head designs for their combination of strength and light weight. However, the material can be quite costly. Steel alloys are more economical; however, since the density of steel alloys is greater than for titanium alloys, steel club heads are limited in size in order to remain within conventional head weights while maintaining durability.

Composite club heads, such as a carbon fiber reinforced epoxy or carbon fiber reinforced polymer, for example, are an alternative to metal club heads. A notable advantage is the relatively light weight compared to stainless steel alloys. However, these club heads have suffered from durability and performance qualities associated with composite materials. These include higher labor costs in manufacture, undesirable acoustic properties of the composite material, shearing and separation of the layers of composite plies used to form the striking surface of the club head and relatively low COR for composite faces.

The areas of the club head that are subject to the greatest wear, the face and sole, have been reinforced in some instances by providing a metal plate in one or both regions. Integrated face and hosel constructions have also been done. However, durability at the junctions of the composite and metal materials continues to be a problem. Further, when the majority of the body of the club head is of composite material, there may still remain the problem of adequately fixing one or more weighting elements within the head body.

The mere increase in volume of the club head may not provide the proper location of the center of gravity of the club head for greater forgiveness in off-center hits.

With regard to hybrid metal-composite club heads, U.S. Pat. Nos. 5,328,176, 5,410,798, and 5,624,331 to Kun-Nan Lo disclose composite-metal golf club heads having a metal casing with an inner member or core of composite material. The inner member reinforces the thin walls of the metal casing in U.S. Pat. Nos. 5,410,798 and 5,624,331. The crown comprises one or two carbon fiber composite portions. The single composite crown portion of U.S. Pat. No. 5,410,798 is attached to the upper ends of the composite member during the heating portion of the manufacturing process. The double composite crown portions of U.S. Pat. No. 5,624,331 are separated by a reinforcing central rib of the metal casing. U.S. Pat. No. 5,328,176 discloses a metal reinforcing plate that is fixed to the front face and wraps around the composite head from front to back.

Published U.S. patent application No. 2002/0,049,310 to Cheng et al. discloses a metal golf club head having a carbon-fiber cover that incorporates the entirety of the upper wall and a majority of the side walls at the toe, rear and heel ends of the head body. The position of the center of gravity of the head is accomplished by the size and placement of weight plugs in the sole and rear side wall. The attachment of the carbon-fiber cover is accomplished by insertion of a bladder through the hole for the plug in the sole and application of aluminum oxide sand where the carbon-fiber cover contacts the metal base and face of the head. The bladder is inflated, and the aluminum-oxide sand adhesively attaches the cover to the rest of the club head during a heating process.

Published Japanese Application No. 05-317465 discloses a golf club head having a hole cut into the crown part. The hole may be closed with a plate of a transparent and lightweight resin. This device allows the weight of the replaced metal material to be substantially distributed to the sole, lowering the center of gravity. An initial speed of a ball is increased and an amount of spin can be decreased, whereby distance can be increased.

Metal, composite and hybrid metal-composite club heads have long suffered from poor acoustic properties. That is, golfers are accustomed to—and desire—a particular range in pitch tone generated by the golf ball impacting the striking face. Some prior club heads have used a foam filling in order to alter the sound while attempting to minimize any adverse impact on performance. While metal club heads have become better matched to golfers' acoustic preferences, composite club heads generally lack acoustic appeal.

It should, therefore, be appreciated, there is a need for a golf club head having a high COR and improved durability and acoustic qualities, which is cost effective and simple to manufacture. The present invention fulfills this need and others.

SUMMARY OF THE INVENTION

The present invention provides a wood-type golf club head having a body, a striking face and a crown. The body is formed from a material having a density of at least about 4 g/cm$^3$ and defines a front opening and an upper opening. The body has a shoulder disposed around a periphery of the upper opening, a recessed support extending from the shoulder and positioned adjacent to the upper opening, a sole and a side section that extends rearward of the front opening. The striking plate is secured to the body, enclosing the front opening. The crown is secured to the body and is supported by the recessed support, enclosing the upper opening. The crown has a maximum thickness no greater than about 2 mm and incorporates composite material having a density between 1 g/cm$^3$ and 2 g/cm$^3$. The crown has a first portion sized to sit on the recessed support of the body such that a side edge of the first portion is proximate to the shoulder of the body, thereby forming a junction between the first portion of the crown and the body. The club further includes a surface veil secured atop the junction.

In a preferred embodiment, the crown includes plies of composite material having a fiber areal weight of between 20 g/m$^2$ and 200 gm$^2$, and the weight of the crown is less than the weight of a similar sized piece formed of the material of the body. At least one of the striking plate and the crown is attached to the body by adhesive bonding.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
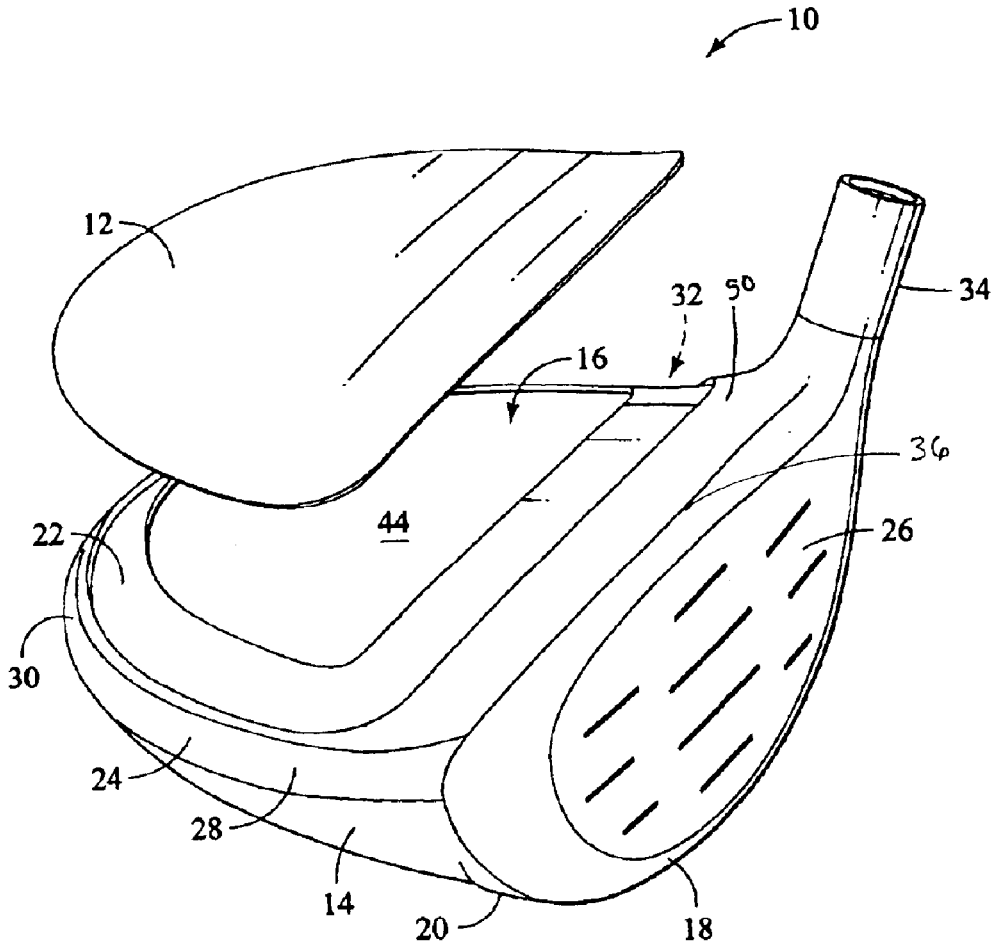
FIG. 1 is a partially exploded perspective view of a preferred embodiment of a head in accordance with the invention, depicting a crown separated from a body portion.

With reference to the illustrative drawings, and particularly FIG. 1, there is shown a golf club head 10 having a crown 12 formed of composite material not yet attached to a body 14 of a golf club head 10 to enclose an opening 16. The body 14 is formed of any g metal, such as an aluminum, steel or titanium alloy, for example. The body 14 may be cast to form a front 18, a sole 20, a top portion 22 and a side portion 24. At the front 18 a striking plate 26 is separately formed and attached to the front of the body 14 in any manner known to those skilled in the art (see FIGS. 4 and 5). The striking plate 26 may be formed of a different alloy or grade of the same metal as the body 14, or the striking plate 26 may be a different metal or a composite material, as desired. If metallic, the striking plate 26 is welded to the front 18; if made of a composite material, the striking plate 26 may be adhesively bonded to the front 18.

In alternative embodiments, the body 14 may comprise three or more portions welded together, where the portions are forged, cast or stamped pieces or any mix thereof. Or, the body 14 may be cast except for a separate sole plate that is attached in the appropriate location. The body 14 may also include one or more attached members, such as weighting elements, that may comprise a metal or other material having a different density than the material of the rest of the body 14.

The side portion 24 extends rearwardly of the front 18 and has a toe region 28, a rear region 30 and a heel region 32 formed above the sole 20. A hosel 34 is provided at the heel end of the body 14 for attachment of a shaft (not shown). The top portion 22 of the body 14 extends rearwardly from an upper edge 36 of the front 18 of the club head 10, above the side portion 24. Thus, the sole 20, top portion 22, front 18 and side portion 24 combine with the crown 12 to form a hollow body 14 having a volume of at least 150 cubic centimeters (cc) and up to 500 cc.

Figure 2:
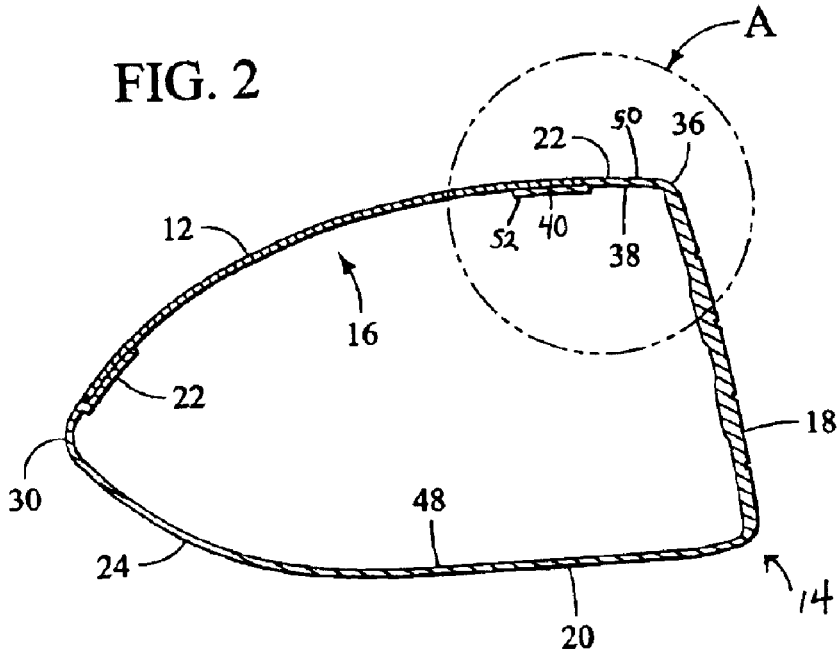
FIG. 2 is a cross-sectional view of the club head of FIG. 1, depicting the crown in place.

As more clearly shown in FIG. 2, the east body 14 includes an annular rim 38 at the opening 16 in the top portion 22 that includes a ledge 40 that acts as a support member for the crown 12. Alternatively, the support member may comprise a plurality of tabs. The size and shape of the support member is preferably chosen to minimize the required overlap with the crown 12 or the mating surface area of the crown 12 and top portion 22.

Figure 3:
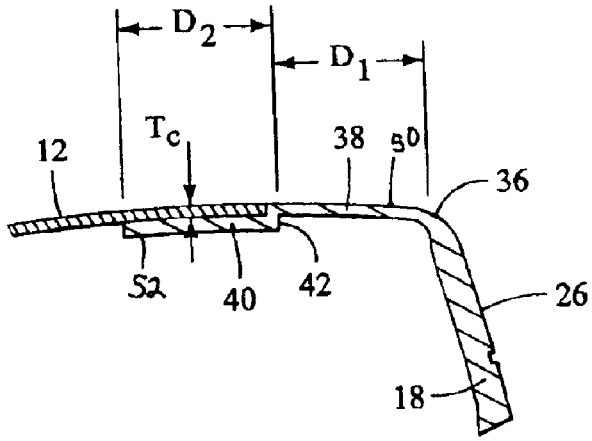
FIG. 3 is a cross-sectional view of Section A of the club head of FIG. 2.

Referring to FIG. 3, the rim 38 extends a distance $D_1$ of at least 7 mm rearward from the upper edge 36 of the front 18, with a shoulder 42 defining the ledge 40 which preferably extends an additional distance $D_2$ of at least 7 mm. The rim 38 preferably extends between 8 mm and 12 mm, and more preferably about 10 mm, from the upper edge 36 while providing advantages of the present invention. Similarly, the ledge 40 preferably extends between 8 mm and 12 mm. Preferably, an adhesive such as Hysol® two part epoxy 9460 or, alternatively, 3M® DP460NS, is used to attach the crown 12 onto the ledge 40, abutting the shoulder 42.

Figure 4:
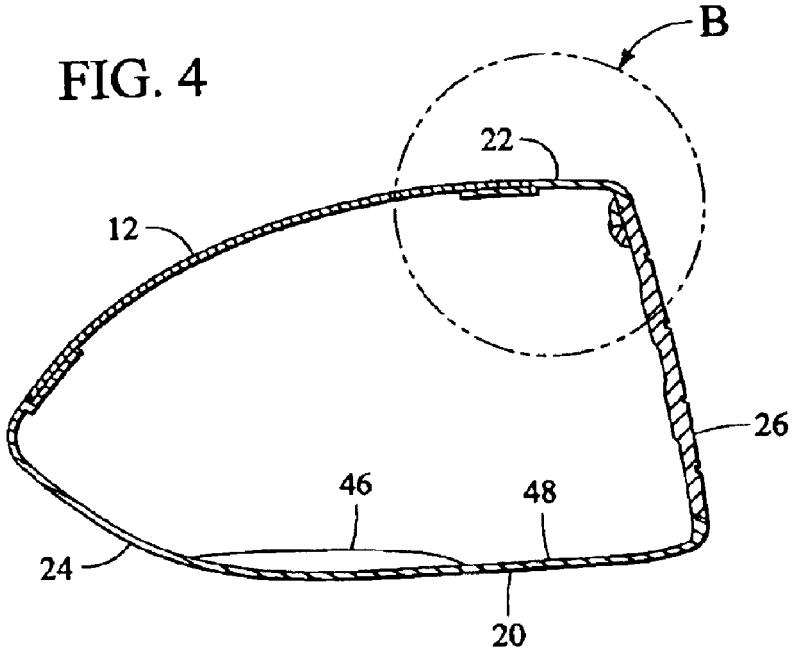
FIG. 4 is a cross-sectional view of a second preferred embodiment of a golf club head in accordance with the invention.
Figure 5:
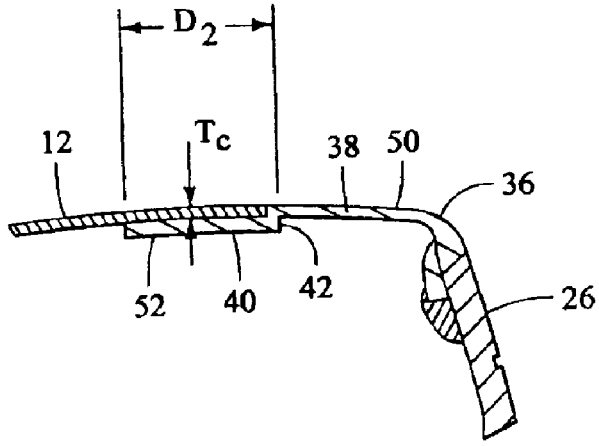
FIG. 5 is a cross-sectional view of Section B of the club head of FIG. 4.
Figure 6:
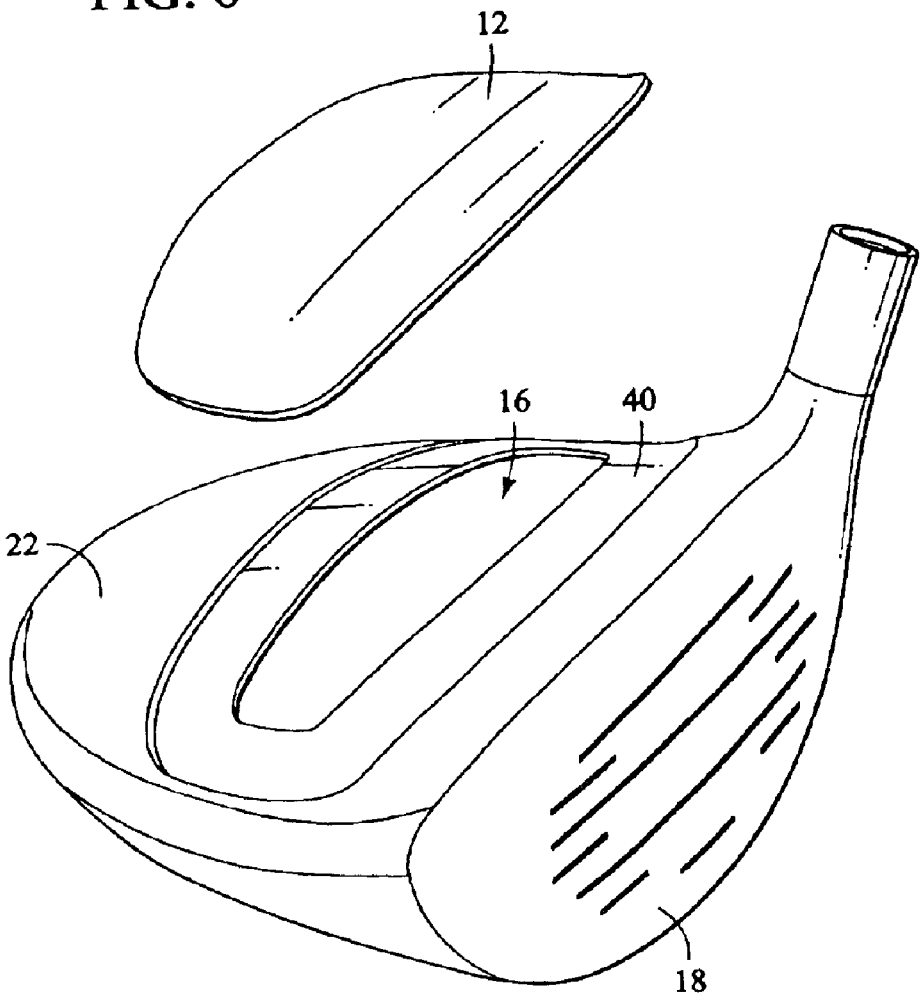
FIG. 6 is a partially exploded view of another preferred embodiment of a club head in accordance with the invention, depicting the composite crown separated from the metal body.

The opening 16 in a central section 44 of the top portion 22 comprises at least 25% (see FIG. 6), and preferably comprises at least 60%, of the total area of the top portion 22. More preferably, the opening 16 is at least 75% of the total area of the top portion 22. Thus, there is a significant weight savings afforded by replacing a similarly sized metal crown with the crown 12 described herein. The difference in weight between the metal and composite materials may be redistributed in the club head 10 to manipulate the center of gravity of the club head 10, such as by providing a weight pad 46 on an interior surface 48 of the sole 20 as shown in FIG. 4. Such a weight pad 46 is preferably formed of a softer metal of lower density than the material of the body 14 of the club head 10 and is attached to the sole 20; although, a weight pad 46 may alternatively be cast as a thickened portion of the sole 20.

Tables I and II show exemplary materials for the body 14 of the club head 10 and the crown 12, respectively. The body 14 preferably has a thin-wall construction, wherein the thicknesses of the sole 20 and side portion 24 is in the range of 0.8 mm to 2 mm and the top portion 22 thickness is in the range of 0.7 mm to 2 mm. The thickness of the front portion 18 is preferably in the range of 1.5 mm to 4 mm. The crown 12 is also of a thin-wall construction, having a thickness $T_c$ of no more than about 2 mm, preferably less than 1.5 mm, and more preferably about 1 mm. In the preferred embodiment of FIGS. 1–3, the thickness of the top portion 22, including the ledge 40, is approximately 1 mm so that the shoulder 42 extends about 2 mm from an outer surface 50 of the top portion 22 to an inner surface 52 of the ledge 40.

TABLE I

EXAMPLES OF METALS FOR THE BODY OF A CLUB HEAD

| Material Type | Density (g/cc) | Ult. Tens. Str. (MPa) | Mod. of Elast. (GPa) | Hardness |
|---|---|---|---|---|
| Mg AZ81A-T4 | 1.8 | 275 | 45 | Brinell 55 |
| Al 1201 Alloy | 2.85 | 430 | 72 | — |
| Ti 6A1-4V | 4.43 | 950 | 113.8 | Brinell 334<br>Rockwell C 36 |
| Ti 15-3-3-3 | 4.76 | 790 | 82 | Rockwell B 95 |
| Carpenter Custom 455 ® | 7.76 | 1100 | 200 | Brinell 318<br>Rockwell C 34 |

TABLE II

EXAMPLES OF COMPOSITE MATERIALS FOR A CLUB HEAD CROWN

| Composite Fiber Material | Density (g/cc) | Ult. Tens. Str. (MPa) | Modulus of Elasticity (GPa) |
|---|---|---|---|
| Carbon Filled Nylon | 1.4 | 103 | 13 |
| DuPont Kevlar ® 49 Fiber, diam 11.9 um | 1.44–1.45 | 2760 | 120–125 |
| Thornel ® VCB-20 Carbon Cloth | 1.88 | 1380 | 138 |

A graphite-epoxy composite material, for example, with a 50% to 70% fiber volume ratio would have a density between about 1.4 g/cc and 1.65 g/cc.

A golf club head 10 constructed in this manner advantageously improves durability since the junction of the striking plate 26 with the top portion 22 is subject to a lesser force at impact with a golf ball. The use of the crown 12 on the metal body 14 also increases COR. Further, the golf club 10 head having a crown 12 on a metal body advantageously provides acoustic qualities judged to be more appealing to golfers.

In one club head 10 tested by the inventors, a 300 cc hollow body 14 was formed of a stainless steel alloy. A large area, 1 mm thick crown 12 was formed of 5 plies including 4 plies of a uni-tape of standard modulus graphite and 1 ply of a woven graphite cloth. The 4 plies of uni-tape were assembled at 0, 45, −45 and 90 degrees and had a fiber area weight (FAW) of about 140 grams per meter squared ($g/m^2$). The standard modulus is approximately 33 Mpsi for the fiber with about 600 Kpsi tensile strength. In comparison, an alternative, and more expensive, ultrahigh modulus fiber (satellite grade) comprises about 57 Mpsi. FAW may range from about 20 to 200 $g/m^2$, and preferably the composite plies for the crown 12 are in the range of 70 to 180 $g/m^2$. More preferably, the composite plies for the crown 12 are in the range of 120 to 160 $m^2$.

The resultant mass of the crown 12 is about 10 grams. This is about a 50% reduction in the mass compared to a crown 12 formed of the steel material of the rest of the club head 10. The calculations of the weight savings must take into account the presence of the ledge 40 with the crown 12, as well as the adhesive. Generally, the weight savings is at least 20% compared to an all metal body 14. The weight pad 46 may then be added to achieve a total mass approximately equivalent to an all metal body 14.

The crown 12 may alternatively be formed of more or less plies, and instead of the top ply being a woven graphite cloth, the top ply may be another uni-tape that is painted to 4 achieve the desired aesthetic look of the club head 10. The top ply is preferably oriented at 0 or 90 degrees. The molding of the crown 12 may be performed using methods known to those skilled in the art and preferably comprises a dual mold to achieve a net shape that requires little finishing and flash removal prior to its attachment to the body 14 of the club head 10.

Another club head 10 tested by the inventors utilized a titanium alloy body 14 for the club head 10, with a crown 12 formed of a thermoplastic material. Preferably, the crown 12 is an injection-molded nylon or polyphenylene sulfide (PPS) material, using 3M® DP460NS adhesive for attachment to the metal body 14. The nylon may be used with or without glass or carbon fiber and preferably has a density between 1 g/cc and 1.7 glcc. Alternatively, the PPS material maybe used with or without glass or carbon fiber and preferably has a density between 1.3 g/cc and 2.0 g/cc. Replacing the crown 12 of the titanium alloy club head 10 results in about a 35% savings in weight. In general, the weight savings is at least 15% compared to an all metal body 14.

The replacement of the crown 12 of a metal club head 10 provides the advantage of weight savings and/or redistribution of mass to the sole 20, for example. A weight pad 46 on the sole 20, or elsewhere on the body 14, may be integrally formed or be a separately formed and attached mass, the resulting weight being comparable to an all metal club head 10 of the same volume.

Figure 7:
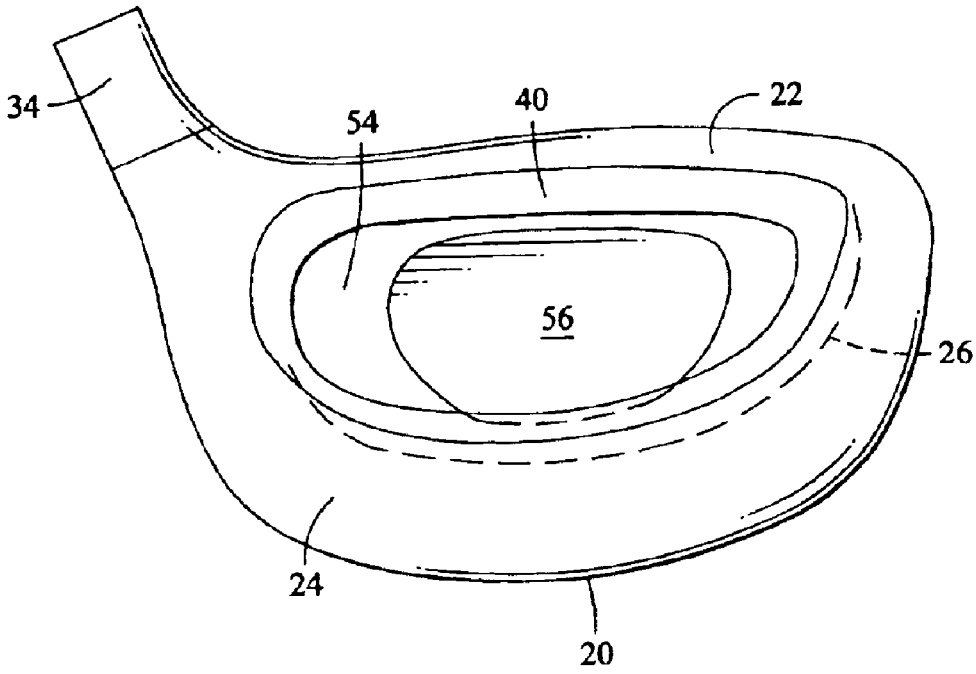
FIG. 7 is a perspective view of a striking face and a body portion of a preferred embodiment of a golf club head in accordance with the invention, depicting a rear surface of the striking face.

Because of the access afforded by the opening in the top 22 of the club head 10, a rear of the striking face 54 is accessible during manufacture for the addition of a face reinforcing member 56 formed of metal or composite material and securely attached behind the sweet spot, as shown in FIG. 7. Thus, a thin titanium alloy striking face 54 can be strengthened or otherwise enhanced in performance. Similarly, any number of additional members may be attached elsewhere on any interior surface 48 of the club head 10.

The use of the aforementioned materials, composite or plastic, for the crown 12 allows the use of a lighter weight material that may result in the top 22 of the club head 10 having a stiffness similar to the heavier, metal sole 22. This stiffness matching may be advantageous for high COR golf club heads.

The golf club head 10 can be assembled with the aid of adhesive bonding. In a preferred method of manufacture, the striking face 22 is securely attached to the body 14, enclosing a front opening. While partially assembled, final weighting and/or other attachment of other members to the interior surface 48 of the club head 10 can be preformed, as desired. Next, the crown 12 is secured in place, forming the top section 22 of the club head 10. Preferably, the crown 12 is of a material having a density less than 2 g/cc with a thickness no greater than 2 mm. At least one of the crown 12 and the striking plate 26 is attached by adhesive bonding to the opening 16 in the body 14. In one embodiment, the mating surfaces of the crown 12 and ledge 40 may be prepared by sandblasting to enhance bonding. Other steps may be performed in order to prepare and/or finish the final club head 10, as known to those skilled in the art.

Figure 8:
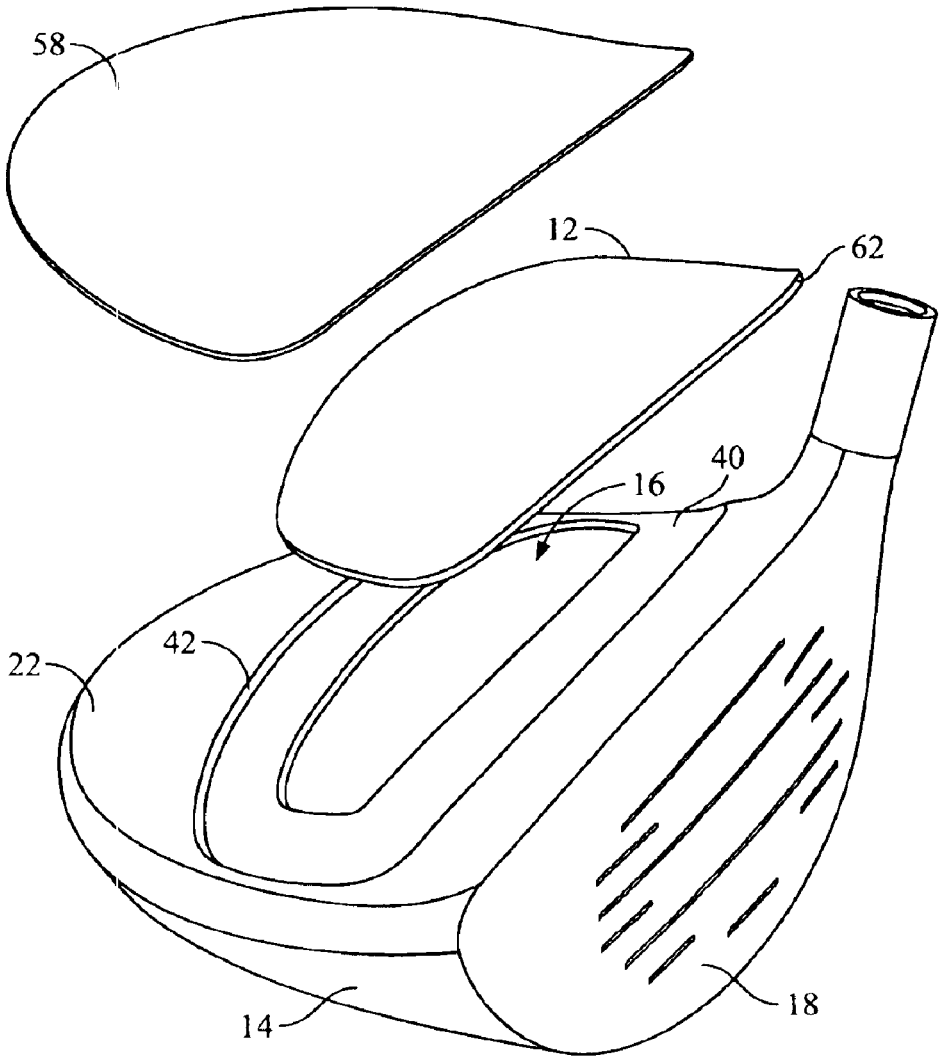
FIG. 8 is a partially exploded perspective view of a third preferred embodiment of a golf club head in accordance with the invention, depicting a crown, including a surface veil covering a top portion of the club head, separated from a body.
Figure 9:
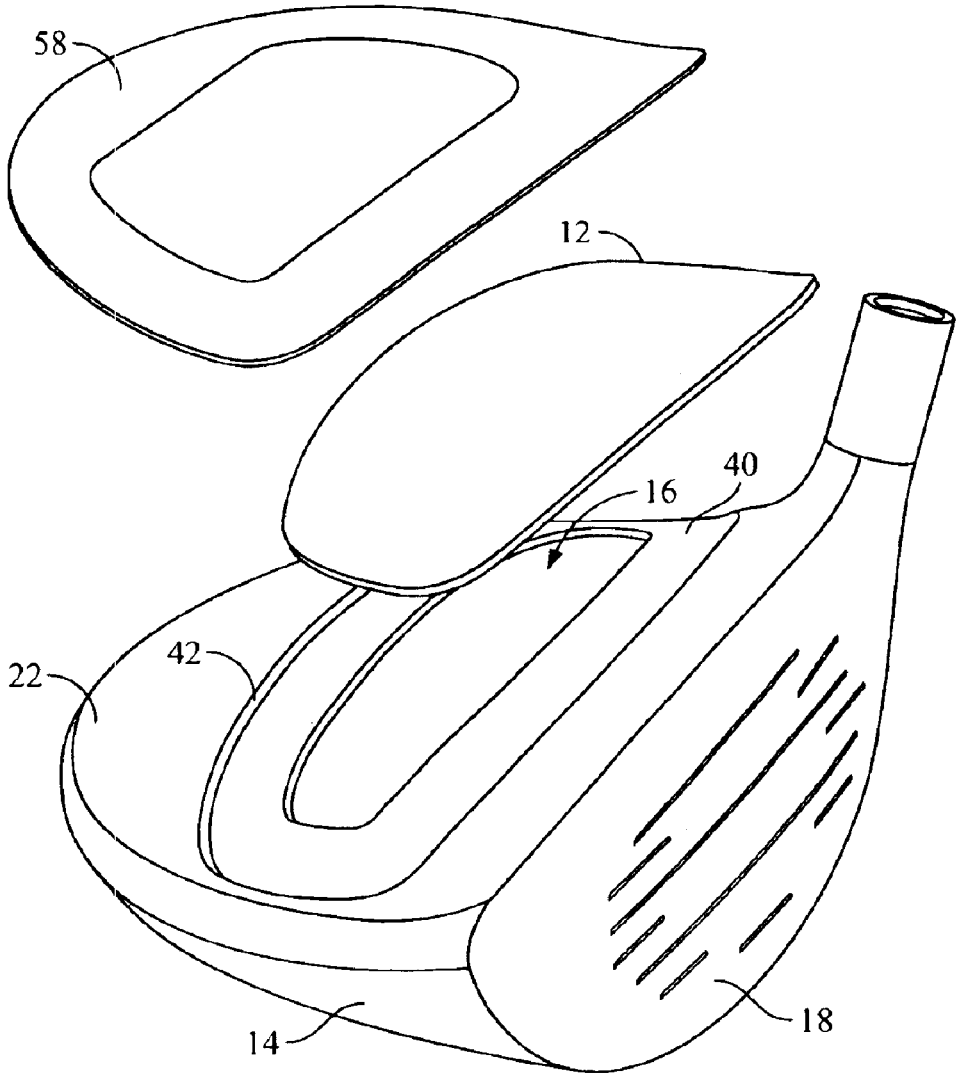
FIG. 9 is a partially exploded perspective view of a fourth preferred embodiment of a golf club head in accordance with the invention, depicting a crown, including a surface veil covering a junction between the crown and body, separated from a body.

With reference now to FIGS. 8 and 9, the golf club head 10 may further include a surface veil 58 sized to cover the junction between the crown 12 and the body 14. The surface veil 58 can include plies of composite material. As shown in FIG. 8, the surface veil 58 can be sized to entirely cover the junction between the crown 12 and the body 14 and the outer surface 50 of the crown. Alternatively, as shown in FIG. 9, the surface veil 58 can be configured to be disposed about the crown 12 to cover the junction between the crown and the body 14. The surface veil 58 aids in preventing cracking and peeling of the club head's surface. In the exemplary embodiments, the surface veil 58 is formed of two additional plies of the material used with the crown 12, as discussed above. In other preferred embodiments, the crown 12 is formed of a first lightweight material, as discussed above, e.g., carbon fiber plies, and the surface veil 58 is formed of a second lightweight material, such as discussed above, e.g., a glass composite.

Figure 10A:
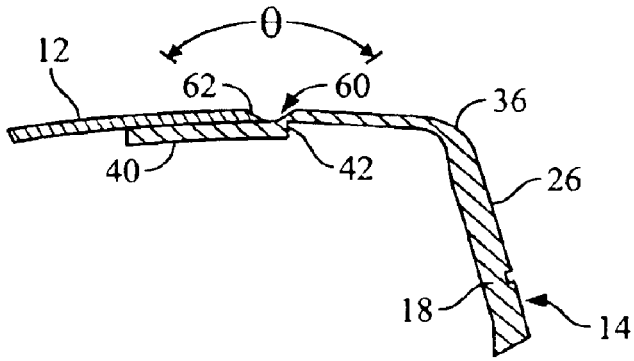
FIGS. 10A–10C are cross-sectional views of a junction of the crown and the body of the club head of FIG. 9, depicting exemplary steps for applying the surface veil.
Figure 10B:
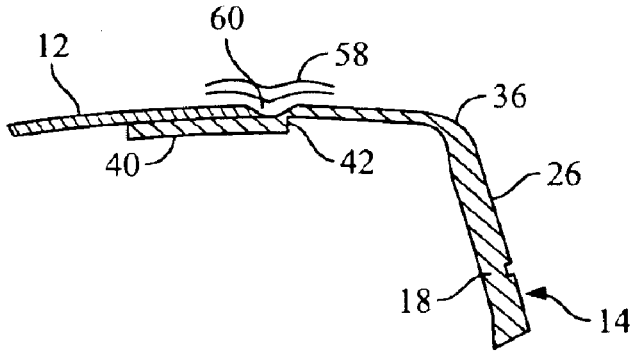
Figure 10C:
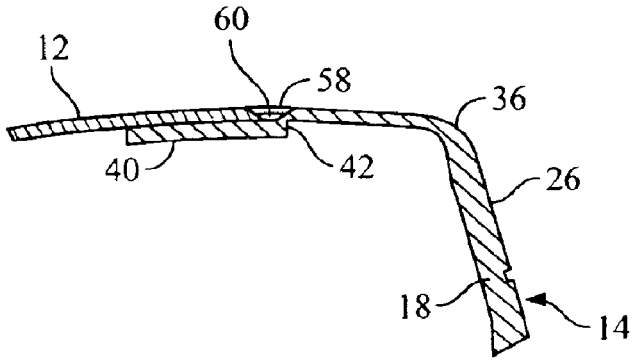

With reference now to FIGS. 10A–10C, an exemplary method of attaching the surface veil 58 is depicted. As shown in FIG. 10A, an obtuse depression 60 is provided at the junction between the crown 12 and the body 14. The depression 60 is preferably formed by providing a taper to at least one of the side edge 62 of the crown 12 and the shoulder 42 of the body. In the exemplary method, both the side edge 62 and the shoulder 42 are tapered, defining an angle θ, which is preferably greater than 90 degrees and less than 180 degrees. The surface veil 58 is attached above the junction between the crown and the body 14 such that it at least partially fills the depression 60 (FIG. 10B). Once in place, the outer surface of the club head 10 undergoes additional treatment, e.g., grinding and/or sanding, to provide a smooth, finished surface (FIG. 10C).

It should be appreciated from the foregoing the present invention provides a golf club head having a high COR that is durable and has desirable acoustic qualities. The club head 10 includes a body 14 a striking plate 26 and a crown 12 forming a hollow cavity of at least 150 cc in volume. The body defines a front opening and an upper opening, and it includes a sole 20 and a side section 24 that extends rearward of the front opening. The striking plate 26 is secured to the body 14 thereby enclosing the front opening. While partially assembled, final weighting and/or other attachment of other members to the inner surface of the club head 10 can be preformed, as desired. The crown 12 is secured to the body 14, thereby enclosing the upper opening. A surface veil 58 may also be provided about a junction of the crown 12 and the body 14. The crown 12 has a maximum thickness no greater than about 2 mm. The density of the crown 12 is less than the density of the body 14. Beneficially, the golf club head 10 has a coefficient of restitution of at least 0.80.

Although the invention has been disclosed in detail with reference only to the preferred embodiments, those skilled in the art will appreciate that additional golf club heads can be made without departing from the scope of the invention. Accordingly, the invention is defined only by the claims set forth below.

We claim:

1. A wood-type golf club head having a maximum coefficient of restitution of at least 0.80 and a volume of at least 150 $cm^3$, the golf club head comprising:

a body formed from a material having a density of at least about 4 $g/cm^3$, the body having;

a sole;

a front opening;

a side section, the side section extending rearward of the front opening and having toe, rear, and heel regions;

an upper opening;

a shoulder disposed around a periphery of the upper opening;

a recessed support extending from the shoulder and positioned adjacent to the upper opening; and a striking plate attached to the body and enclosing the front opening; and a crown secured to the body and supported by the recessed support, thereby enclosing the upper opening, the crown incorporating composite material having a density between 1 $g/cm^3$ and 2 $g/cm^3$, the crown having:

a maximum thickness no greater than about 2 mm;

a first portion sized to sit on the recessed support of the body such that a side edge of the first portion is proximate to the shoulder of the body, thereby forming a junction between the first portion of the crown and the body; and a surface veil secured atop the junction.

2. The golf club head of claim 1, wherein:

the body is cast from a titanium alloy;

the side section has a thickness between about 0.8 mm and about 2 mm;

the striking plate is welded to the body;

the maximum thickness of the crown is no greater than about 1.5 mm;

the side edge of the first portion of the crown and the shoulder of the body are tapered, thereby defining an angle greater than about 90 degrees and less than about 180 degrees;

the veil includes plies of composite material; and the veil covers the junction between the first portion of the crown and the body.

3. The gulf club head of claim 2, wherein the titanium alloy is 6Al-4V Ti.

4. The golf club head of claim 2, wherein the veil is formed from two plies of the same composite material incorporated by the crown.

5. The golf club head of claim 1, wherein the surface veil covers the entire length of the junction between the first portion of the crown and the body.

6. The golf club head of claim 1, wherein the surface veil entirely covers an upper surface of the first portion of the crown.

7. The golf club head of claim 6, wherein the surface veil entirely covers the crown.

8. The golf club head of claim 1, wherein at least one of the side edge of the first portion and the shoulder of the body portion has a tapered profile, thereby forming a depression about the junction, and wherein the surface veil at least partially fills the depression.

9. The golf club head of claim 8, wherein the side edge of the first portion and the shoulder of the body portion define an angle greater than about 90 degrees and less than about 180 degrees.

10. The golf club head of claim 1, wherein the surface veil is comprised of plies of composite material.

11. The golf club head of claim 10, wherein the surface veil and the crown are comprised of the same composite material.

12. The golf club head of claim 1, wherein the surface veil and the crown are comprised of different materials.

13. The golf club head of claim 12, wherein the crown is comprised of carbon fiber plies and the surface veil is comprised of a glass composite.

14. The golf club head of claim 1, wherein the striking plate and the body are comprised of different materials or different grades of the same metallic material.

15. A wood-type golf club head having a maximum coefficient of restitution of at least 0.80 and a volume of at least 150 $cm^3$, the golf club head comprising:

a body formed from a material having a density of at least about 4 $g/cm^3$, the body having:

a sole;

a front opening;

a side section, the side section extending rearward of the front opening and having toe, rear, and heel regions;

an upper opening;

a shoulder disposed around a periphery of the upper opening;

a recessed support extending from the shoulder and positioned adjacent to the upper opening; and a striking plate attached to the body and enclosing the front opening; and a crown attached to the body and supported by the recessed support, thereby enclosing the upper opening, the crown including plies of composite material having a fiber areal weight of between 20 $g/m^2$ and 200 $g/m^2$, the crown having:

a maximum thickness no greater than about 2 mm;

a first portion sized to sit on the recessed support of the body such that a side edge of the first portion is proximate to the shoulder of the body, thereby forming a junction between the first portion of the crown and the body; and a surface veil secured atop the junction;

wherein the weight of the crown is less than the weight of a similar sized piece formed of the material of the body, and wherein at least one of the striking plate and the crown is attached to the body by adhesive bonding.

16. The golf club head of claim 15, wherein:

the body is cast from a titanium alloy;

the side section has a thickness between about 0.8 mm and about 2 nun;

the striking plate is welded to the body;

the maximum thickness of the crown is no greater than about 1.5 mm;

the side edge of the first portion of the crown and the shoulder of the body are tapered, thereby defining an angle greater than about 90 degrees and less than about 180 degrees;

the veil includes plies of composite material; and the veil covers the junction between the first portion of the crown and the body.

17. The golf club head of claim 16, wherein the titanium alloy is 6Al-4V Ti.

18. The golf club head of claim 16, wherein the veil is formed from two plies of the same composite material incorporated by the crown.

19. The golf club head of claim 15, wherein the surface veil covers the entire length of the junction between the first portion of the crown and the body.

20. The golf club head of claim 15, wherein the surface veil entirely covers an upper surface of the first portion of the crown.

21. The golf club head of claim 20, wherein the surface veil entirely covers the crown.

22. The golf club head of claim 15, wherein at least one of the side edge of the first portion and the shoulder of the body portion has a tapered profile, thereby forming a depression about the junction, and wherein the surface veil at least partially fills the depression.

23. The golf club head of claim 22, wherein the side edge of the first portion and the shoulder of the body portion define an angle greater than about 90 degrees and less than about 180 degrees.

24. The golf club head of claim 15, wherein the surface veil is comprised of plies of composite material.

25. The golf club head of claim 24, wherein the surface veil and the crown are comprised of the same composite material.

26. The golf club head of claim 15, wherein the surface veil and the crown are comprised of different materials.

27. The golf club head of claim 26, wherein the crown is comprised of carbon fiber plies and the surface veil is comprised of a glass composite.

28. The golf club head of claim 15, wherein the striking plate and the body are comprised of different materials or different grades of the same metallic material.

* * * * *